United States Patent [19]

Strössner

[11] 4,019,006

[45] Apr. 19, 1977

[54] OVERCURRENT AND SHORT CIRCUIT PROTECTION DEVICE

[75] Inventor: Manfred Strössner, Erlangen, Germany

[73] Assignee: Siemens Aktiengesellschaft, Munich, Germany

[22] Filed: Jan. 2, 1975

[21] Appl. No.: 538,199

Related U.S. Application Data

[63] Continuation-in-part of Ser. No. 438,438, Jan. 31, 1974, Pat. No. 3,282,147.

[30] Foreign Application Priority Data

Feb. 5, 1973 Germany ..... 2305533
Nov. 12, 1973 Germany ..... 2356410

[52] U.S. Cl. ..... 200/144 R; 200/147 R; 337/250

[51] Int. Cl.[2] ..... H01H 33/08; H01H 33/18

[58] Field of Search ..... 200/147 R, 144 R, 149 A, 200/148 C; 337/250; 313/231

[56] References Cited

UNITED STATES PATENTS

| | | | |
|---|---|---|---|
| 1,396,357 | 11/1921 | Clemens | 337/250 |
| 1,944,403 | 1/1934 | Clerc | 200/148 C |
| 2,443,017 | 6/1948 | Arone et al. | 200/144 R |
| 2,861,152 | 11/1958 | Scully | 200/144 R |
| 3,259,780 | 7/1966 | Stetson | 313/231 |
| 3,515,829 | 6/1970 | Hurtle et al. | 200/147 R |
| 3,588,405 | 6/1971 | Bailey et al. | 200/149 A |
| 3,649,791 | 3/1972 | Kruckewitt | 200/148 C |

*Primary Examiner*—Robert S. Macon
*Attorney, Agent, or Firm*—Kenyon & Kenyon Reilly Carr & Chapin

[57] ABSTRACT

An electric overcurrent and short-circuit protection device which utilizes a pair of horn electrodes with a fusible conductor connected therebetween. The electrodes are arranged, together with suitably adapted insulating walls to form a first arc-quenching chamber with the walls of said chamber spaced apart by a predetermined narrow gap extending in the plane of the electrodes for a predetermined distance. The walls have a plurality of holes therethrough, which have a predetermined length and diameter. This inner chamber is arranged within a second quenching chamber, at least one wall of which is provided with holes therethrough.

13 Claims, 3 Drawing Figures

OVERCURRENT AND SHORT CIRCUIT PROTECTION DEVICE

RELATED APPLICATIONS

This application is a continuation-in-part of application Ser. No. 438,438 filed Jan. 31, 1974 now U.S. Pat. No. 3,282,147.

BACKGROUND OF THE INVENTION

This invention pertains generally to overcurrent and shortcircuit protection devices, but particularly to those devices wherein an arc-quenching chamber is required.

THE DESCRIPTION OF THE PRIOR ART

Of course, the use of arc-quenching chambers is not something new in this art. Devices exist, such as that described in U.S. Pat. No. 3,259,780 wherein the chamber walls of the arc-quenching chamber are made from a highly porous material. When the arc is generated it moves in the direction of the plane of the walls of the chamber through action of its own magnetic field. The expanding arc pushes the hot gases ahead of itself. The gases penetrate the walls to the exterior but because the gas permeability of the porous material forming the walls of the chamber is not that high, relatively speaking, a sufficient pressure head develops, particularly where arcs of high current intensity are involved, for example those greater than 400 amps, with the result that the gases escaping ahead of the arc exert a decelerating effect on the arc.

The German Auslegeschrift 1,014,623 also depicts a quenching chamber arrangement whose boundary walls consist of a highly porous material but, which, too, experiences a decelerating effect due to the relatively low permeability of the wall material.

An alternate approach to the construction of arc-quenching chambers, but which still employs chamber walls comprised mainly of porous material, is described in German Pat. No. 1,004,717. Therein, is described a system where the arc follows a circular path up to the point of extinction due to the fact that it bases are made to travel over the electrodes in circular paths.

It is primarily an object of this invention, therefore, to provide a quenching chamber which can quickly supress arcs having current intensities substantially greater than 400 A.

It is another object of this invention to provide a quenching mechanism which includes means for accelerating the speed of the arc in the area of the electrodes.

It is still another object of this invention to include means which will minimize refiring of the arc once it has been extinguished.

SUMMARY OF THE INVENTION

The present invention is based on the discovery that the use of a gas permeable porous material having pores which form very narrow passages will still result in the gases escaping ahead of the arc forming a pressure head for an arc of high current intensity for example one of substantially more than 400 A and will thereby exert a decelerating effect on the arc.

The objects of this invention are fulfilled by a protection device which utilizes a pair of horn electrodes having a fusible conductor positioned therebetween. The electrodes are arranged, together with suitably adapted walls to form a first arc-quenching chamber. The walls of the first chamber are spaced apart by a predetermined narrow gap. They extend from the horn electrodes, in a plane containing said electrodes, a predetermined distance. The walls of the first chamber have a plurality of holes therethrough, the holes having a predetermined length and diameter. The cross-sectional area of the holes represent a predetermined percentage of the surface area of the chamber walls. The inner chamber is arranged within a second quenching chamber. One of the walls of this second chamber is also provided with holes of predetermined cross-sectional area. The inside walls of the inner chamber can be coated with a material which is easily vaporized at temperatures generated by the arc which is created. The gases generated upon vaporization increase the pressure in the chamber behind the arc, thereby enhancing the acceleration of the arc. Further the gas generated, can be such as to be relatively hard to ionize thereby inhibiting reignition of the arc after extinction.

The use of the double chamber with the plurality of holes in the first chamber allows the hot gases to escape through the holes after which a portion of them will escape through the outer chamber. However, a portion of the hot gases will be fed back into the inner chamber behind the arc thereby preventing any deceleration forces on the arc.

It has also been discovered that a certain specific sizing and area of holes in the inner chamber is necessary for proper operation. The hole diameter must be at least 0.8 mm, more preferably 1 mm to 1.2 mm and cannot appreciably exceed 2.5 mm. The total cross-section taken up by the holes should be in the range of 30 to 50% of the total inside surface of the arc-quenching chamber. With a design of this nature, the flow resistance of the walls to hot gases is substantially lower than chamber walls using a porous material. The maximum limitation on the hole size is necessary to prevent an arc from extending out through the hole. That is to say that although the arc can penetrate into the individual holes, limiting holes to this size will result in no new arc being formed at the outer surfaces of the inner arc-quenching chamber.

Additionally, slot means can be provided surrounding a fusible conductor which because of the narrow gap of the slot result in an acceleration of the arc when it is first generated.

All of the above contribute to allow quick extinguishment of the arc even for relatively large currents. All these features, particularly the size and number of the holes as well as the dimension of the chambers, allow for controlling the quenching speed and thus the quenching time.

BRIEF DESCRIPTION OF THE DRAWINGS

Reference is now made to the accompany drawings for a better understanding of the nature and objects of this invention. The drawings illustrate the best mode presently contemplated for carrying out the object of the invention and its principles, and are not to be construed as restrictions or limitations on its scope. In the drawings.

DETAILED DESCRIPTION OF THE PREFERRED EMBODIMENT

Figure 1:
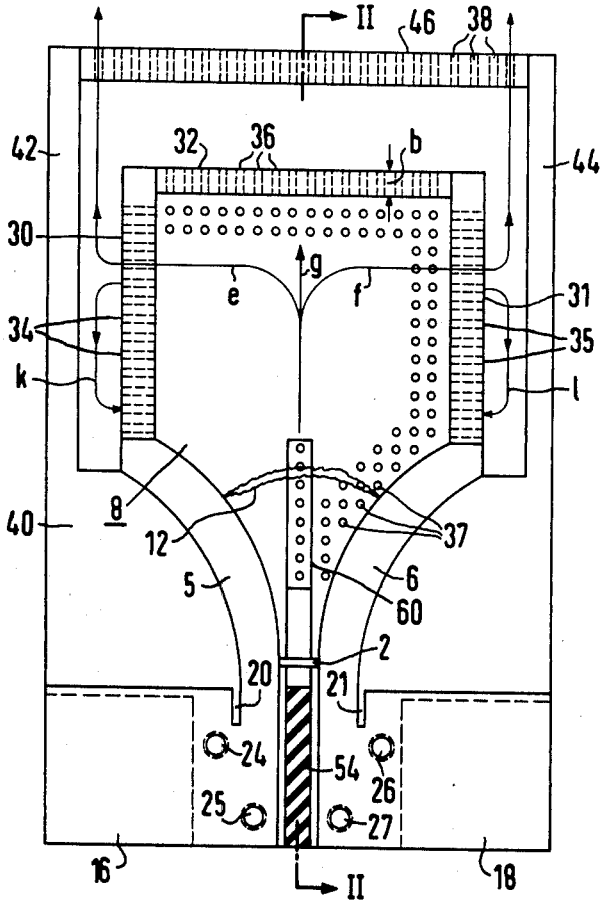
FIG. 1 is an elevation, sectional view of the invention.

Referring to FIG. 1, a pair of horn electrodes, 5 and 6 are shown, which include corresponding terminal members 16 and 18. Connected between the horn electrodes, 5 and 6, is a fusible conductor 2. The terminal members 16 and 18 are provided with holes 24, 25, 26 and 27, which are suitable for connecting the horn electrodes 5 and 6 in series with the particular conductor to be monitored and which can be utilized to hold the individual parts of the invention together. Slots 20 and 21 are contoured in the respective electrode-terminal member section. These provide for an improved current loop associated with the arc when generated and can be used to improve the extinguishment time of the arc to some degree. The horn electrode-terminal member pairs, are fabricated from a highly, electrically conducted material, such as copper. The fusible conductor 2 in an installation where the nominal voltage is 1000 volts and the nominal current is 700 A, may have a cross-sectional area of 1.2 $mm^2$ and a length of approximately 7 mm.

The horn electrodes 5 and 6 terminate at a side walls 30 and 31 respectively. These are secured to the respective electrode in a suitable fashion. At a predetermined distance from the end of the horn electrodes, an end wall 32 is positioned between the side walls 30 and 31. Covering the outline formed by the horn electrodes, the side walls 30 and 31, and the end wall 32 are bottom and top lids, or walls, 40 and 41 respectively. These latter walls, 40 and 41, form a closed inner chamber with the horn electrodes and the side and end walls.

An outer chamber is formed by a lower and upper cover plate 50 and 51 which are parallel to and which are secured to the bottom and top lids 40 and 41 at a point close to where the spacing between the electrodes is a minimum. The lower and upper cover plates extend in the same direction as the inner chamber and are closed off on the top side by end piece 46. The sides of the outer chamber are enclosed by side walls 42 and 44 connected with the correspondingly enlarged bottom 40 as illustrated. The bottom and top lid 40 and 41 may be extended in the vertical direction, as viewed in FIG. 2, beyond end wall 32, until they meet the outside chamber end wall 46 at which point they are joined to the wall. The walls of the inner and outer chamber are fabricated from an insulating material such as asbestos slate, a ceramic material, or even, perhaps, a mica-containing plastic material.

The walls 30, 31, 32, 40 and 41 of the inner chamber have a plurality of parallel openings therethrough. The diameter and mutual spacing between the plurality of parallel holes is chosen so that their total cross-sectional area represents 30 to 50% of a given unit of area. The diameter of parallel openings should be in the range of 0.8 to 2.5 mm. More preferably is a diameter of more than 1 mm, for example about 1.2 mm. Such diameter holes permit adequate flow-cross section but, when maintained within the maximum limitation, prevent any possibility of the arc getting outside the inner chamber. Similar parallel openings are formed in the end wall 46 of the outer chamber. The bottom and top lid 40 and 41 are separated by a predetermined distance, *d*. The gap width *d* is generally in the range of 3 to 8 mm, and preferably 4 to 6 mm. Further, the lower and upper cover plates 50 and 51 are spaced apart from the bottom and upper lid 40 and 41 at a distance *a*. This gap, *a*, generally falls between 1 and 5 mm, and may be preferably selected in the range of 1.5 to 3 mm.

The thickness, *b*, of the side and end walls 30, 31 and 32 as well as the thickness *c* of the bottom and top lids, 40 and 41, essentially determined by the nominal current to be seen by the device. For instance, for currents in the range of 400 Amps, a wall thickness of about 5 mm is sufficient. For larger currents, for example, 800 Amps or more, the thickness would lie in the range of 7 to 15 mm with a particularly favorable quenching effect obtained for wall thickness of 8 to 12 mm. For still larger currents, particularly those in excess of 1,000 Amps, the chamber wall thickness they run up to 20 mm. The wall thickness for the various current ratings indicated, pertain to those situations where the installation nominal voltage is on the order of 1,000 volts or more.

Once a particular fusible conductor is melted because of an overcurrent or short-circuit condition, the hot gases generated propagate in front of the arc 12 and flow towards the side and end walls as indicated by the arrows *e*, *f* and *g*. Additionally, the hot gases exit through the holes in bottom and top lids, 40 and 41 along the paths identified as *h*, *i*, *m* and *n*. The gases emanating from the first chamber are in part vented from the second chamber through the holes 38 in wall 46 along paths *h*, *i* and *p* and are in part fed back to the inner chamber along paths *m* and *n* and paths *k* and *l*, behind the arc 12. Allowance for gases to emanate through end wall 36 results in a substantial reduction of the cutting-out noise generated by the device. The gases fed back behind the moving arc 12 preventing the generation of a vacuum behind the arc thus avoiding any decelerating effect that such a vacuum might cause.

Figure 3:
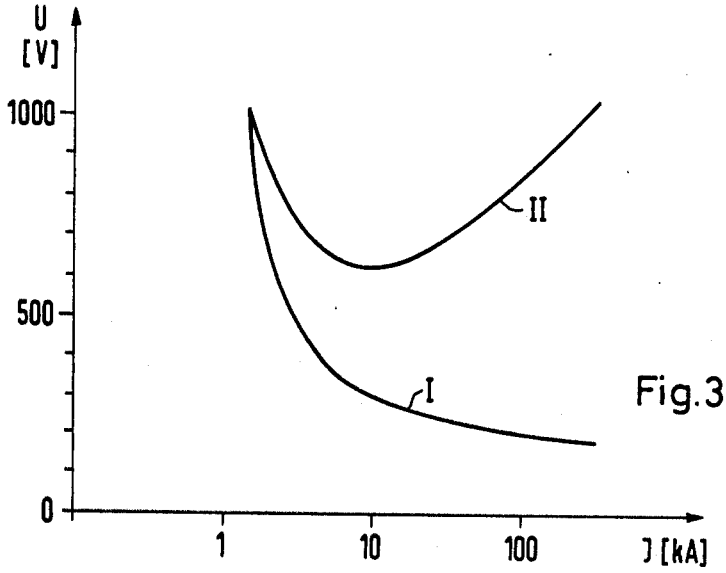
FIG. 3 is a graph of the voltage-current characteristics of the prior art and present invention arc-quenching chambers.

As may be seen from the diagram of FIG. 3, in which the arc voltage U is plotted versus the arc current, the arc characteristic for the present invention, II, has a substantially changed pattern as compared to the characteristic, I, which represents a free-burning arc of a prior art fuse with horn electrodes. Curve I has a continuously descending characteristic. However, due to the intensive cooling in the narrow gap *d*, of the inner chamber, curve II first descends to a minimum voltage level and then, reversing itself, extends in an ascending manner for higher currents. This reflects the improved extinguishing characteristics of the present invention.

Figure 2:
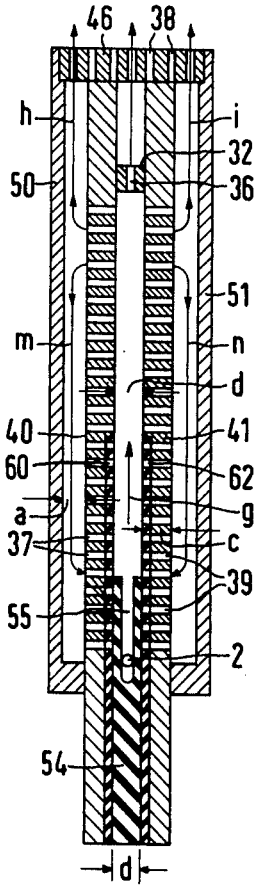
FIG. 2 is an elevational sectional view taken along lines 2—2 of FIG. 1.

FIGS. 1 and 2 show a strip-shaped insert 60, which is embedded in a corresponding recess on the inner surface of bottom lid 40. The insert is positioned so as to face the fusible conductor. Holes are drilled through the insert such that they align themselves with holes in lid 40. This insert, 60, is fabricated from an easy-to-evaporate material which gives off a gas, upon vaporization by the temperatures created by arc 12, which is hard to ionize. Such easily evaporated materials suitable for the application would be any halogen containing epoxy resins and melamine resins, as well as polyoxymethylene which goes by the trade name Delrin. When the arc is generated, this material vaporizes at the elevated temperatures created by the arc. The generated gas behind the arc provides an increase in gas pressure which accelerates the arc on the one hand, and, because of the fact that it is hard to ionize, reduces the danger of reignition of the arc particularly in the area of minimum spacing between the electrodes. The insert 60 extending in the direction of the motion of the arc can be replaced to allow reuse of the quenching chamber. A similarly configured insert 62 may be inserted into a corresponding recess of lid 41 if it is desired.

In addition to the use of inserts 60 and 62, or even as an alternate to this latter approach, the chamber walls, at least that part of of the walls which face the fusible wire 2, can be coated with a similar, easily vaporized material. Again the gas that is generated behind the arc accelerates the arc and prevents reignition of the arc at the point of minimum spacing between the electrodes.

As a further improvement upon the quenching speed of the present invention, the fusible wire 2 can be positioned in a slot-shaped portion 54 which is sandwiched between the bottom and the top lid 40 and 41. The height of the slot is such that is does not appreciably exceed the diameter of the fusible conductor 2. The fusible wire is position at the bottom of this slot thereby initially providing a still narrower gap for the arc than the gap *d*, between the bottom and top lids 40 and 41. When the arc is first generated, the narrower slot results in a further squeezing thereo such that its starting velocity is increased accordingly. Additionally, the insert 54 may be fabricated, at least in part, from the same easily evaporated material as the inserts 60 and 62 or which is used to coat the inner surfaces of the walls of the inner chamber.

Other variations of the specific construction disclosed above can be made by those skilled in the art without departing from the scope of the present invention as defined in the appended claims.

What is claimed is:

1. Improved apparatus for electrical overcurrent and short circuit protection of the type in which a fusible wire is arranged in an arc-quenching chamber between first and second electrodes which, after the fusible wire is melted through, forms with the arc a current loop generating magnetic forces which act to elongate the arc, comprising:

a. a pair of horn electrodes coupled to the first and second electrodes;

b. an inner arc chamber comprising:

1. first and second sidewalls comprising extensions of said pair of horn electrodes;
2. an end wall abutting said first and second sidewall;
3. a bottom wall covering one side of said horn electrodes and said side walls and endwalls;
4. a top wall covering the other side of said horn electrodes, side walls and end wall;
5. said top and bottom walls being disposed parallel to each other and forming a gap which is of a sufficiently small thickness such that the voltage current characteristic of the arc has a descending portion to a minimum value with increasing current, after which it then rises for large currents and, wherein,
6. said top, bottom side walls and end walls each contain a plurality of mutually parallel holes having a diameter in the range of 0.8 to 2.5 mm and having a total cross section which is 30 to 50% of the inside area of said arc-quenching chamber; and c. an outer arc-quenching chamber surrounding said inner arc-quenching chamber, said outer arc-quenching chamber having at least one wall provided with mutually parallel holes.

2. Apparatus according to claim 1 wherein said gap width between said top and bottom is in the range of 3 to 8 mm.

3. Apparatus according to claim 2 wherein said range is 4 to 6 mm.

4. Apparatus as in claim 1 wherein said hole diameters are at least 1.2 mm.

5. Apparatus according to claim 1 wherein the length of said holes is at least 5 mm.

6. Apparatus in claim 5 wherein said length is at least 7 mm.

7. Apparatus as in claim 6 wherein said length is between 8 and 12 mm.

8. The device of claim 1 wherein said first chamber includes a slot-shaped portion wherein part of said fusible wire is positioned, said slot having a height not appreciably greater than the diameter of said fusible wire.

9. The device of claim 8 wherein the extent of the slot is substantially greater in the direction of motion of the arc than in the opposite direction.

10. The device of claim 1 wherein at least that portion of said pair of walls bounded by said electrodes and facing said fusible wire is fabricated from a material which evaporates at a temperature generated by said arc.

11. The device of claim 10 wherein the material of fabrication of said insert, upon evaporation, gives off a gas which is hard to ionize.

12. The device of claim 8 wherein said slot-shaped portion is fabricated from a material which evaporates at a temperature generated by said arc.

13. The device of claim 12 wherein the material of fabrication of said slot-shaped portion upon evaporation, gives off a gas which is hard to ionize.

* * * * *